US005293765A

United States Patent [19]

Nussbaum-Pogacnik

[11] Patent Number: 5,293,765

[45] Date of Patent: Mar. 15, 1994

[54] METHOD AND APPARATUS FOR THE MANUFACTURE OF THREADED ALUMINUM CONTAINERS

[75] Inventor: Thomas E. Nussbaum-Pogacnik, Frauenfeld, Switzerland

[73] Assignee: E. Nussbaum AG, Matzingen, Switzerland

[21] Appl. No.: 869,296

[22] Filed: Apr. 16, 1992

[30] Foreign Application Priority Data

Apr. 17, 1991 [CH] Switzerland ..... 01 149/91-9

[51] Int. Cl.[5] ..... B21H 3/04

[52] U.S. Cl. ..... 72/42; 72/103; 72/120

[58] Field of Search ..... 72/94, 120, 121, 124, 72/379.4, 256, 42, 103

[56] References Cited

U.S. PATENT DOCUMENTS 2,145,587 1/1939 Draper ..... 72/124
3,815,402 6/1974 Duran et al. ..... 72/94
3,832,962 9/1974 Rolles .

FOREIGN PATENT DOCUMENTS 204046 11/1983 German Democratic Rep. .
210136 8/1989 Japan ..... 72/379.4
1445758 8/1976 United Kingdom .

*Primary Examiner*—Lowell A. Larson
*Attorney, Agent, or Firm*—Walter C. Farley

[57] ABSTRACT

Deep drawn, deep drawn and stretched, or extruded cylindrical aluminium containers are varnished internally and externally, provided with a twostage neck by drawing in and onto the neck is rolled a thread, followed by cutting to length. The drawing-in of the neck, thread rolling and cutting to size are performed with the same container setting. To improve the flexibility, adhesiveness and sliding characteristics, the varnish used is mixed with catalysts, plasticizers and/or lubricants. When the thread is rolled, the container neck is supported from the inside with a quasi-stationary screw-pitch gauge, while from the outside a thread roll is rolled over the neck surface and presses the thread inwards into the neck. The screw-pitch gauge and the thread roll are forcibly guided in such a way that a slip occurs between them and the neck material. As a result the varnish also remains intact in the vicinity of the thread.

12 Claims, 4 Drawing Sheets

METHOD AND APPARATUS FOR THE MANUFACTURE OF THREADED ALUMINUM CONTAINERS

FIELD OF THE INVENTION

The invention relates to a method and to an apparatus for the manufacture of threaded aluminium containers or cans, particularly deep drawn, deep drawn and stretched, or extruded, internally and externally lacquered or varnished aluminium cans provided with a bottle thread. The invention also relates to a varnished or lacquered, threaded aluminium container or can.

BACKGROUND OF THE INVENTION

The prior art discloses the shaping of flat, circular aluminium pieces by drawing so as to form cylindrical containers, which are internally and externally varnished and then the container opening is narrowed by drawing in and flanging and made ready for the attachment of a cap or closure. Such containers are e.g. further processed to form aerosol monoblock containers. Varnishing and in particular the printing of inscriptions or decorative patterns prior to drawing in is advantageous, because lacquer or varnish can only be rolled on to cylindrical containers. Even internally, where the varnish is sprayed on, this can take place more easily on the still cylindrical container.

Varnishing the insides of aluminium containers is necessary for all those applications in which a bare aluminium surface would be attacked by the container contents. Whenever during storage and use the container content comes into contact with the container inner surface, it is important for the internal varnish to cover said surface in an absolutely uninterrupted manner.

For the methods for the manufacture of varnished aluminium containers according to the prior art, varnishes have been developed, which are so adhesive, elastic and slidable that cylindrical, varnished aluminium containers can be drawn in in bottle-like manner without damaging the varnish.

As aluminium is a very satisfactory and inexpensively recyclable packing material, it would be appropriate and desirable if it would be possible to manufacture, from aluminium, containers onto which could e.g. be screwed a hand pump with a riser tube or a screw cap, in the same way as with plastic or glass bottles. The aluminum container could e.g. be marketed filled with the screw cap closed. The consumer would only have to screw and then unscrew the multiply usable pump onto the aluminum container and to either refill or recycle the container without extraneous material. For this purpose aluminum containers with corresponding threads and advantageously standardized threads are necessary.

SUMMARY OF THE INVENTION

Therefore, an object of the invention is to provide a method and an apparatus enabling a thread, particularly a standardized thread, to be applied to aluminum containers, particularly those varnished on the inside and outside. It is particularly important for the varnish and especially the internal varnish not to be damaged by the application of the thread, because in the aforementioned use of such a container the thread is internally in contact with the container contents. The method and the apparatus must be integratable into known production lines for the production of deep drawn, deep drawn and stretched, or extruded, varnished aluminum containers, i.e. the thread must be manufacturable in the same setting as the other working steps such as the drawing-in of the neck, the cutting to size of the container, etc. and in a cycle time of approximately 0.3 to 0.6 sec. and an effective processing time of 0.035 to 0.07 sec. There should be no need to clean the containers following the fitting of the thread, i.e. the method and the apparatus must not require the addition of lubricants, or a lubricant must be used which is neither prejudical to the container content, nor to the container appearance.

The most important features of the inventive method are as follows. The thread is produced by a tool rolling on the outer neck side and a quasi-stationary tool internally supporting the container material on the inside of the neck. The two tools operate in forcibly controlled manner in such a way that slip occurs between the neck and the tool. This largely prevents any accumulation of neck material ahead of the tools so that material is not displaced in the tool movement direction, which would lead to oval threads and would highly stress and damage the varnish.

BRIEF DESCRIPTION OF THE DRAWINGS

The inventive method, the inventive apparatus and the aluminum container produced by the inventive method are described in exemplified manner hereinafter relative to the drawings, wherein.

DESCRIPTION OF THE PREFERRED EMBODIMENTS

Figure 1:
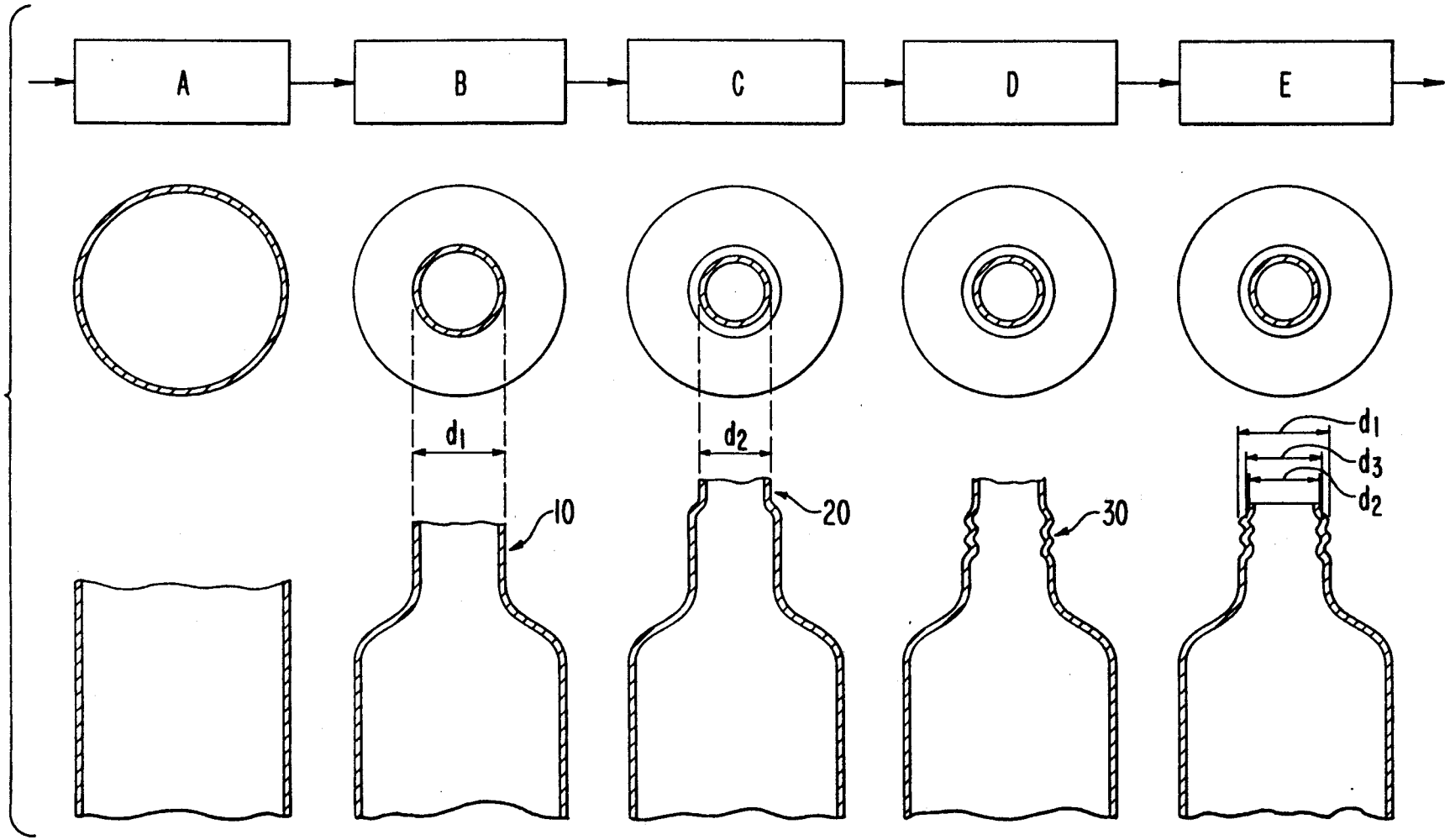
FIG. 1 is a schematic plan view of the sequence of steps for forming an aluminum article in accordance with the present invention.

FIG. 1 shows the basic method steps of the method according to the invention. The method steps are represented as blocks in a sequence diagram and under it and in diagramatic form are shown the container shape changes produced by the individual method steps in the form of a plan view in longitudinal section through the container neck part.

From flat, usually circular portions of a deep drawable or extrudable aluminium alloy, cylindrical cans or containers are produced in known manner by deep drawing, deep drawing and additional stretching, or extrusion. The container wall thickness must be maximally 20% of the pitch of the thread used for the container.

Following drawing, drawing and stretching, or extrusion the containers are cleaned to remove the lubricant necessary for the drawing process. Then, in a first step of the inventive method A (varnishing), they are internally and externally varnished and optionally printed, while they still have a cylindrical shape. The varnishes used are e.g. polyester or epoxyphenol varnishes. To improve the flexibility, adhesiveness and sliding characteristics they are mixed with one or more additives, which in known manner are constituted by plasticizers, catalysts and lubricants. The equipment used for varnishing are the same as the known equipment enabling the application of the internal varnish by spraying and the external varnish by a corresponding roll. After varnishing the varnishes are correspondingly dried and polymerized.

For the following method steps the containers are attached to a revolving table, whose stepwise rotation supplies them to the vicinity of successive tools, which are mounted on a tool plate or platen. A corresponding apparatus is described in the Lechner Swiss patent 394 998/65 and is assumed to be known.

In two following method steps B and C, each container is stepwise drawn in and, as a function of the container diameter, the desired container shape and the material used, said two method steps can comprise various effective drawing-in steps using different tools. During the first drawing-in B, the container is given a convergent shoulder and a substantially cylindrical, first neck portion 10, while during the second drawing-in C a second, narrower and substantially cylindrical neck portion 20 is connected to the first neck portion 10. The external diameter $d_1$ of the first neck portion 10 substantially corresponds to the external diameter of the thread to be produced, and the external diameter $d_2$ of the second, narrower neck portion 20 is slightly smaller than the core diameter $d_3$ of the thread to be produced.

The shape of the drawn-in shoulder is not relevant to the method according to the invention. It is obviously also possible to manufacture a container without a shoulder, i.e. a substantially cylindrical threaded container and in such a case method step B is omitted. Methods and tools for drawing in aluminium cans are known. The Expert can adapt them for the drawing-in to the described neck shape, so that there is no need to describe them here.

In a following method step D a thread 30 is rolled onto the first neck portion 10 or the part of the latter facing the second neck portion 20. The thread is produced by a thread roll rolling around the outer circumference of the first neck portion 10, which is pressed against a quasistationary screw-pitch gauge in the interior of the neck. Thus, the thread is pressed inwards from the outside of the neck, so that the external diameter of the completely rolled thread corresponds to the original neck diameter $d_1$. Its core diameter $d_3$ is slightly larger than the external diameter $d_2$ of the second neck portion 20. The thread runs out against the second neck portion 20, i.e. it does not extend to the neck edge. This prevents the neck edge being deformed from its precise circular cylindrical shape as a result of thread rolling. The inventive apparatus used for method step D will be described in greater detail in conjunction with FIGS. 2, 3 and 4.

In a following method step E the container neck is cut to length, e.g. directly over the upper runout of the thread. If the container is to be used in conjunction with a hand pump, the connection between the neck edge and the pump connection must be tight. As a function of the seal type used it can be advantageous to make the face of the container neck either straight or slightly sloping. Methods and apparatus for cutting container necks to length are known and need not therefore be described here.

In order to ensure continuous, rapid and economic production, it is necessary to perform method steps B, C, D and E with the same container setting. Therefore the method steps must be dependent on a basic time cycle, which is given by the corresponding production machine. If the thread is to be rolled in such a cycle, this means for a standard production rate of between 100 and 200 containers per minute, that a cycle time between 0.6 and 0.3 sec. is available for thread rolling during which the container is moved to the corresponding location, the tools are brought into the working position and the thread is rolled. A working time between 0.035 and 0.07 sec. is available for the thread rolling process.

Figure 2A:
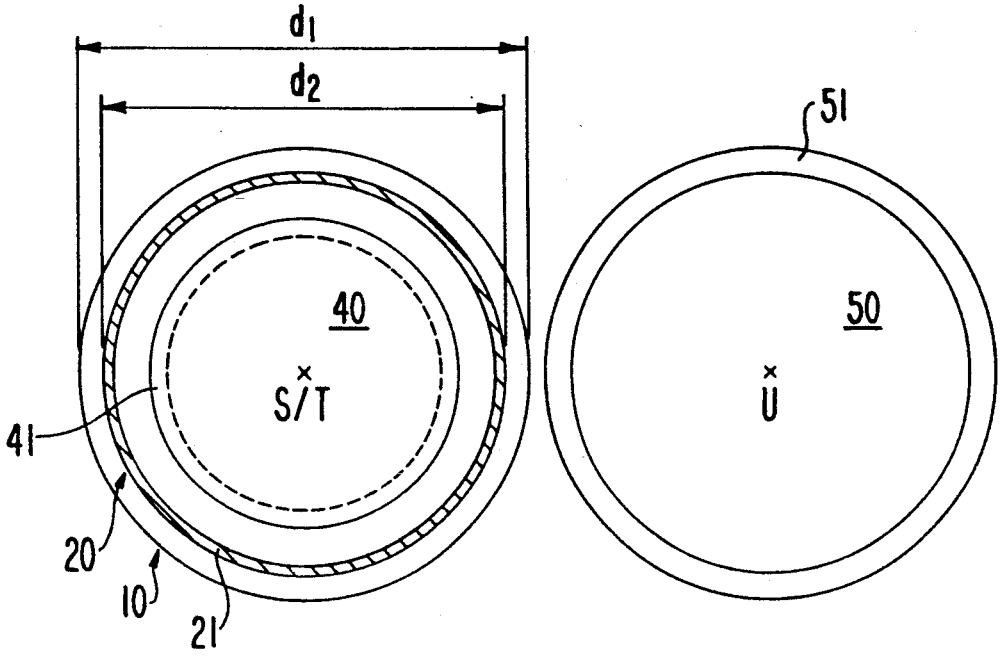
FIGS. 2*a* and 2*b* are end views of a container and forming tools showing the step of thread rolling and especially the relative positions of the tools before (FIG. 2*a*) and during (FIG. 2*b*) rolling.
Figure 2B:
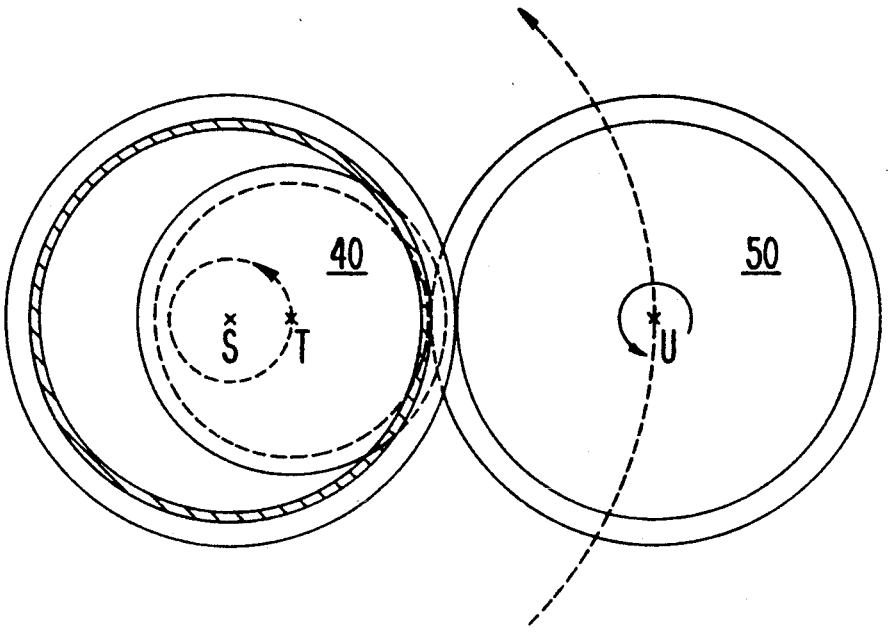
Figure 3A:
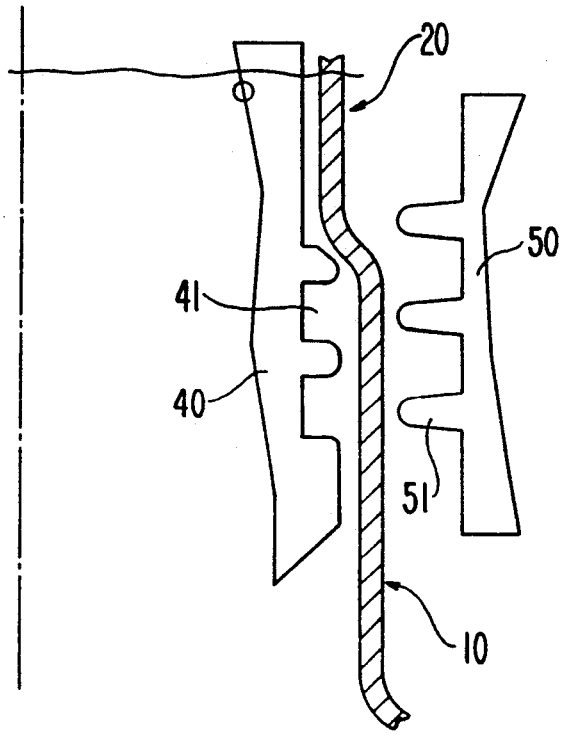
FIGS. 3*a* and 3*b* are partial sectional views of a wall of the container showing the tools in the positions of FIGS. 2*a* and 2*b;*
Figure 3B:
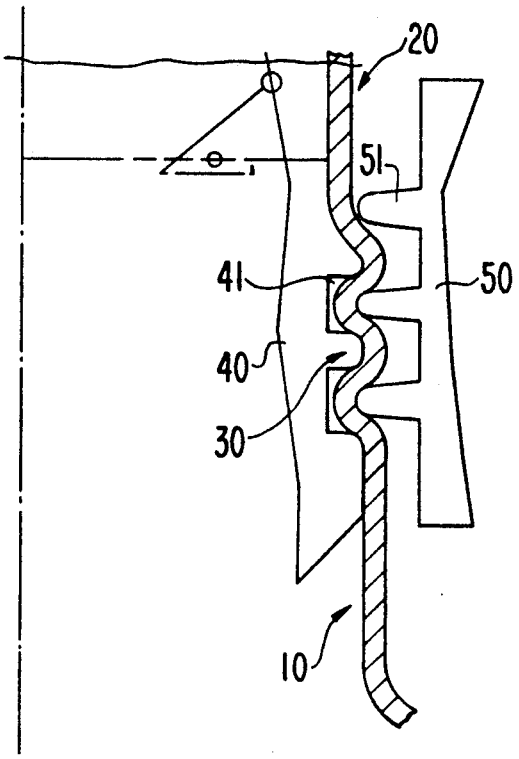

FIGS. 2*a* and *b* show in detailed end view the method and tools used for rolling the thread. FIG. 2*a* shows the tools prior to the thread rolling process and FIG. 2*b* shows the tools during it.

The only parts of the container which are visible are the circular face 21 of the second neck portion 20 with the external diameter $d_2$ and the first neck portion 10 with the external diameter $d_1$. For the thread rolling process a substantially cylindrical or slightly frustum-shaped screw-pitch guage 40 is introduced into the container neck. The largest gauge diameter is such that it can be introduced without difficulty through the second neck portion 20. On its lateral face the gauge carries a slightly distorted, negative image 41 of the thread to be rolled, which is indicated in broken line form in this plan view. During the introduction process the container neck and gauge are arranged coaxially, i.e. their rotation axes S and T coincide.

Advantageously, simultaneously with the introduction of the screw-pitch gauge into the container neck, a thread roll 50 is positioned outside the latter and which is designed in such a way with a thread shape (constructed as a bead 51 to be drawn in spiral manner around the roll), that without having to be axially moved, it can roll the entire thread. During the introduction process the thread roll is spaced from the neck in such a way that it does not come into contact therewith.

For the effective thread rolling process the gauge 40 and the thread roll 50 are so moved against one another by the displacement of their axes T and U, that the gauge 40 comes into contact with the inner surface of the first neck portion at the point where the thread roll 50 is externally positioned and the thread shape 51 of the thread roll 50 is pressed into the neck material by the thread depth of the thread to be rolled. Simultaneously the thread roll 50 is rolled on the neck and therefore in coordinated manner the rotation axis of the gauge is rotated about the container rotation axis that the gauge always engages on the neck and supports the neck material where the thread roll has just rolled.

In this closed state the two tools are at least once moved around the container neck and in this way the thread is produced. Once the thread has been rolled, the gauge 40 and thread roll 50 are again brought into the introduction position (FIG. 2*a*) and removed axially from the container.

During the rolling of the thread, the thread roll 50 is so rolled in forcibly controlled manner that the circumferential distance rolled on the roll is greater than that rolled on the neck. Consequently slip occurs between the thread roll and the neck, so that although the thread roll rolls in one direction over the neck circumference, it also always slips on the neck surface in the opposite direction. As a result of this slip, which leads to a force in opposition to the movement direction of the thread roll 50 on the neck material, it is ensured that the roll does not accumulate the neck material in front of it and move it in the rolling off direction.

As the circumference of the screw-pitch gauge 40 is smaller than the inner circumference of the first neck portion 10, which it has supported during the thread rolling process, a slip also occurs between the gauge 40 and the inner surface of the first neck portion 10, so that the gauge 40 slips on the neck inner surface in the movement direction of the thread roll 50.

As a result of this slip on both sides, the particularly advantageous circumstances occur, which lead to ensuring the concentricity of the thread and that the container varnish is not damaged. The slipping of the thread roll and the gauge leaves behind on the varnish tracks, which can be detected as slight surface changes to the varnish in the vicinity of the thread.

Corresponding to FIGS. 2*a* and 2*b*, FIGS. 3*a* and 3*b* show the tools used for the thread rolling process before (FIG. 3*a*) and during (FIG. 3*b*) the thread rolling process, namely as a section along the container rotation axis, only one side of the container neck being shown. The constructions of the screw-pitch gauge 40 and the thread shape 51 of the thread roll 50 are clearly visible. The threads 41 of the gauge need only correspond to the shape of the finished thread in the thread depth and the lead, but must not have sharp edges in the area where they come into contact with the shaped inner surface. The thread shape 51 of the thread roll 50 must have a shape corresponding to the shape of the thread to be produced. Advantageously the screw-pitch gauge 40 is constructed in such a way that it not only supports the inner surface of the first neck portion 10, but also at least partly the inner surface of the second neck portion 20, although no thread is rolled thereon.

Figure 4:
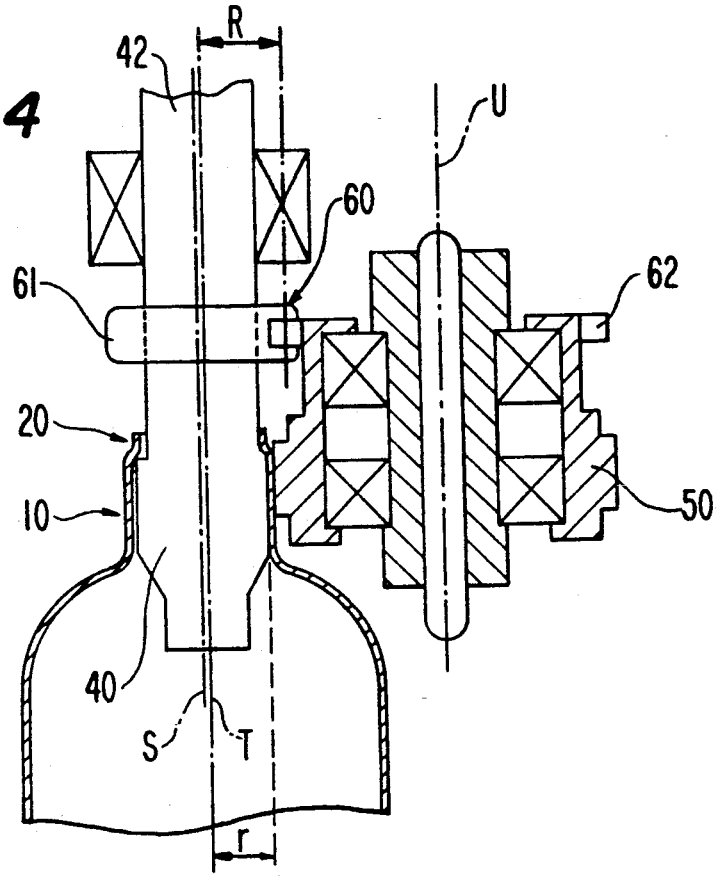
FIG. 4 is a schematic view in side elevation of an apparatus in accordance with the invention in partial section along a plane passing through the central axis of the container being formed.

FIG. 4 diagrammatically shows the inventively relevant parts of an apparatus for thread rolling on containers in an exemplified embodiment. FIG. 4 is a section along the container rotation axis S, the two neck portions 10 and 20 of the container being visible. The gauge 40 and the thread roll 50 are in a position corresponding to their positions in FIGS. 2*b* and 3*b*. The axis T of the gauge 40 is not located on the container rotation axis S, so that the roll 50 presses into the neck material.

In particular it is possible to see the means 60 with the aid of which the slip is produced between the thread roll 50 and the container neck. Said means comprise a toothed rim 61, which is fitted to the shaft 42 of the gauge 40 and a second toothed rim 62 running in the first toothed rim 61 and which is fitted to the thread roll 50. If the axis U of the thread roll 50 is now moved about the axis T of the gauge 40, the thread roll rolls in forcibly controlled manner on the container neck through the toothed drive 60. As the rolling-off radius r of the roll 50 on the container neck is smaller than the rolling radius R of the toothed rim 61, slip is formed between the roll 50 and the neck in such a way that the roll 50 slips counter to its run-off direction on the neck material. It has proved advantageous to choose the two radii r and R in such a way that $R:r \geqq 1.1$.

The drawing does not show the drives for the axial movement of the apparatus parts before and after the effective thread rolling process and for the rotary movement of the thread roll 50 about the container neck and the circular movement of the axis T coupled thereto. For the axial movement use is advantageously made of the timed movement of the tool plate on which are mounted the tools for the other method steps. The circular movement of the thread roll e.g. driven by means of a belt drive.

The coupling of the movement of the thread roll 50 and the axis T of the gauge 40, as well as the control of the relative movement of the two axes T and U before and after the effective thread rolling process can be obtained by corresponding asymmetrical wedge arrangements, the relative movement of the two axes being brought about by a relative axial movement of said wedge arrangements.

The movement of the axis T about the axis S can be brought about in that the axis T described a cylinder envelope about the axis S, or the axis T describes a cone about the axis S. For the case of the cylindrical movement the gauge 40 must be cylindrical, while for the conical movement the gauge 40 must be frustum-shaped, with its end tapering towards the container.

Figure 5:
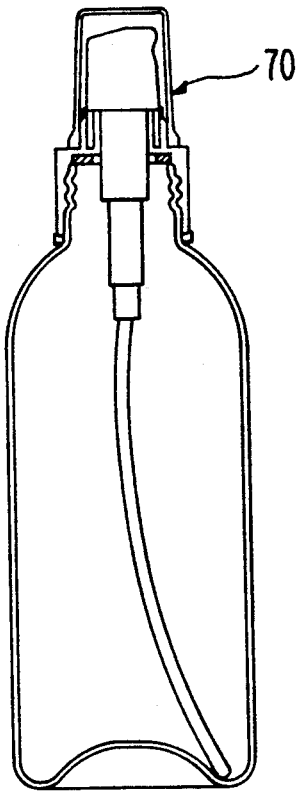
FIG. 5 is a side elevation, in section, of a container in accordance with the present invention.

FIG. 5 shows a container closed by a hand pump 70, to which a thread has been applied by the inventive method. The thread can correspond to any standard for such threads, e.g. the European standard. It has been found that a thread produced according to the inventive method has an accuracy of approximately ±0.1 mm, which is much greater than that of corresponding plastic or glass threads. As shown in FIG. 5, it is consequently not necessary to improve the centering of the screwed-on pump by a corresponding perforation on the container neck end facing the shoulder. The container bottom shape is not relevant for the inventive method. The represented container e.g. has an inwardly curved bottom.

I claim:

1. A method for forming threads on an aluminum container comprising the steps of forming a container having an open end, positioning first and second thread-rolling tools adjacent inside and outside surfaces of the container, respectively, adjacent the open end, moving the thread-rolling tools against the surfaces of the container to form threads, and rotatably driving the second tool to produce slipping contact between the container surfaces and the tools while the threads are being formed.

2. A method according to claim 1 and including the step of varnishing the container surfaces before forming the threads.

3. A method according to claim 2 and including the steps of attaching the container to a support for forming the thread, and including the additional steps of drawing-in the open end of the container before forming the threads to form a neck, and cutting the container to a predetermined length.

4. A method according to claim 1 and including the steps of attaching the container to a support for forming the thread, and including the additional steps of drawing-in the open end of the container before forming the threads to form a neck, and cutting the container to a predetermined length.

5. A method according to claim 1 wherein the thread-rolling tools include a screw-pitch gauge which is positioned inside the container and a thread roll rolled around the outside of the container so that the thread roll presses container material into the gauge.

6. A method according to claim 5 wherein the thread roll rotates and slips counter to the direction of its motion relative to the container.

7. A method according to claim 6 wherein the screw-pitch gauge rotates and slips counter to the direction of its motion relative to the container.

8. A method according to claim 1 and including the step of varnishing the container surfaces before forming the threads with a varnish including additives to have increased adhesiveness and flexibility and improved sliding characteristics.

9. A method according to claim 8 wherein the additives include a catalyst.

10. A method according to claim 8 wherein the additives include a plasticizer.

11. A method according to claim 8 wherein the additives include a lubricant.

12. A method according to claim 1 and further including, before forming the threads, the step of drawing in the open end of the container to form a substantially cylindrical neck portion having an external diameter substantially equal to a core diameter of the thread to be formed on said neck portion.

* * * * *